United States Patent [19]

Rogers

[11] 4,329,794

[45] May 18, 1982

[54] RIPPING ATTACHMENT FOR DRAGLINE

[75] Inventor: James B. Rogers, Lakeland, Fla.

[73] Assignee: Dresser Industries, Inc., Dallas, Tex.

[21] Appl. No.: 132,725

[22] Filed: Mar. 24, 1980

[51] Int. Cl.[3] ..... E02F 3/76

[52] U.S. Cl. ..... 37/115; 37/117.5; 37/DIG. 3

[58] Field of Search ..... 299/67, 26; 37/115, 37/117.5, 103, DIG. 3, 141 R, 141 T, 118 R; 172/777-778

[56] References Cited

U.S. PATENT DOCUMENTS

| | | | |
|---|---|---|---|
| 1,245,118 | 10/1917 | Moore | 37/115 X |
| 1,560,895 | 11/1925 | Crowe | 37/115 |
| 1,659,768 | 2/1928 | Dietrich | 37/118 R X |
| 1,719,576 | 7/1929 | Voit | 37/118 R |
| 2,482,320 | 9/1949 | Clemmer | 37/141 T |
| 2,840,931 | 7/1958 | Appel | 37/117.5 |
| 3,039,210 | 6/1962 | Slaughter | 37/117.5 |
| 3,061,123 | 10/1962 | Rogers | 37/103 |
| 3,307,277 | 3/1967 | Kondracki | 37/141 |
| 3,430,703 | 3/1969 | Richey | 172/136 |
| 3,596,996 | 8/1971 | Carter | 37/117.5 X |
| 3,702,712 | 11/1972 | Cairns | 299/67 |
| 3,724,899 | 4/1973 | Clark | 299/26 |
| 4,279,085 | 7/1981 | Arnold | 37/117.5 |

FOREIGN PATENT DOCUMENTS

| | | | |
|---|---|---|---|
| 610929 | 6/1978 | U.S.S.R. | 37/141 T |

*Primary Examiner*—E. H. Eickholt

*Attorney, Agent, or Firm*—John M. Lorenzen

[57] ABSTRACT

The invention concerns an earth ripping attachment which can be mounted on the bucket of a dragline and used to break through cap rock, frozen earth, or other difficult to dig overburden. The device has a base adapted to fit against the underside of the bucket. An upwardly folded lip at one end of the base receives and engages the digging edge of the bucket, while means provided at the other end connects to the bucket hoist rigging to secure the attachment in place. One or more ripper teeth are spaced below the base and point in the drag direction. With this attachment the full drag force of the dragline and the weight of the bucket are utilized in the ripping operation.

5 Claims, 4 Drawing Figures

RIPPING ATTACHMENT FOR DRAGLINE

FIELD OF THE INVENTION

The invention relates to draglines, and more particularly, to a novel ripper attachment which can be conveniently connected to a conventional dragline bucket and used to break up cap rock, frozen earth, or other difficult to dig overburden.

BACKGROUND OF THE INVENTION

A dragline is a large and expensive piece of equipment and the economic operation of one depends heavily on minimal down time. However, it occasionally happens that the operation of such a dragline is interrupted when the operator encounters certain consolidated overburden; for instance, such as frozen ground or cap rock that was unaffected during the blasting operation. To attempt digging such materials with the dragline can cause damage or excessive wear to the bucket, therefore conventional practice is to shut the dragline down and bring in smaller equipment, such as a dozer or blasting equipment. Depending on the situation, the dragline may well be out of operation for several days with obvious significant impact on the mine operating cost.

Accordingly, it is the object of this invention to provide an earth ripping device which can be attached to a conventional dragline bucket so that the dragline itself can be used to rip through and break up otherwise undiggable soils without the need to wait for auxilliary equipment.

It is a further object to provide a ripping attachment for a dragline bucket which will take fullest advantage of the dragline's tremendous power and the weight of the dragline bucket during the ripping operation.

It is a still further object to provide a ripping attachment with the aforesaid advantages which can be quickly and easily connected to the dragline bucket.

These and other objectives are achieved by the invention which comprises a ripper attachment having a base adapted to fit against the underside of the dragline bucket. At the forward end of the base is an upwardly folded lip which fits over the leading or digging edge of the bucket, and at the other end some means for connecting the attachment to the bucket hoist ropes is provided. Connected to but spaced below the base is at least one large ripping tooth with its cutting edge pointing substantially in the drag direction of the machine.

Using this device it will not be necessary to shut down the dragline when cap rock, frozen earth, or other difficult overburden is encountered. Rather, the attachment will be brought into the area of the dragline's swing radius, the operator will bring his bucket around and slip its leading edge into the lip of the attachment, and a ground worker will attach the connecting means to the bucket hoist ropes. The dragline operator will then swing the bucket with attachment over and place it onto the difficult overburden. Then as he pulls on his drag ropes, the ripper tooth will bite into the surface and will be pulled along with the full power of the machine's drag system. At the same time, the entire weight of the bucket will apply a downward force to enhance the ripper's penetration.

These and other features of the invention will be apparent and appreciated in the more detailed description which follows with reference to the accompanying drawings, which form an integral part of the specification.

DESCRIPTION OF THE PREFERRED EMBODIMENT

Figure 1:
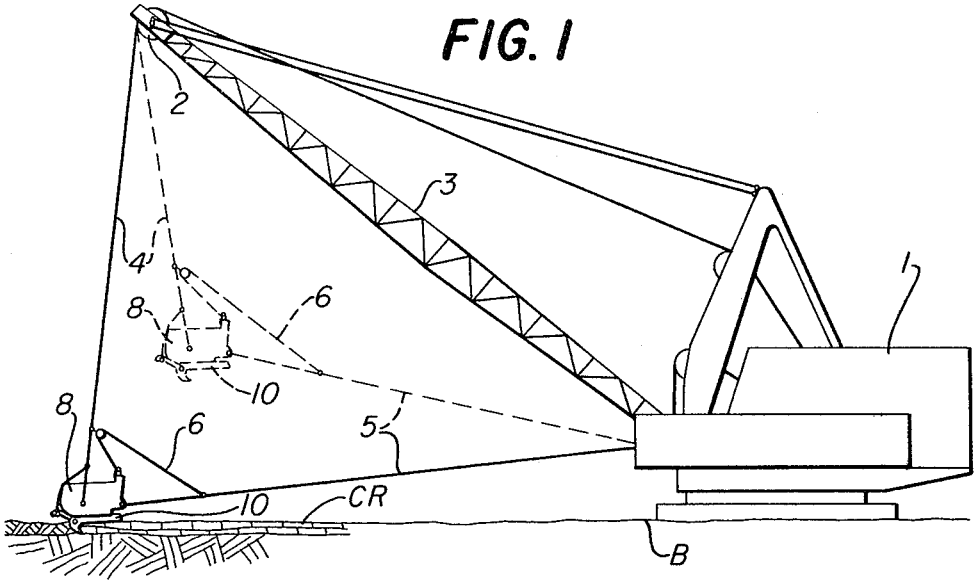
FIG. 1 is an elevational view of a typical dragline illustrating the application of a ripping attachment in accordance with the invention.

FIG. 1 shows a typical dragline 1 positioned on a bank of overburden B. The dragline's bucket 8 is conventionally suspended from the boom point 2 of the boom 3 by hoist ropes 4. The bucket is further connected to the machine by the drag ropes or cables 5 and the dump ropes 6 by which the operator can tilt and empty it. FIG. 1 also shows a ripping attachment 10 embodying the invention attached to the bucket and shown rippring into a layer of cap rock or the like designated at CR.

Figure 2:
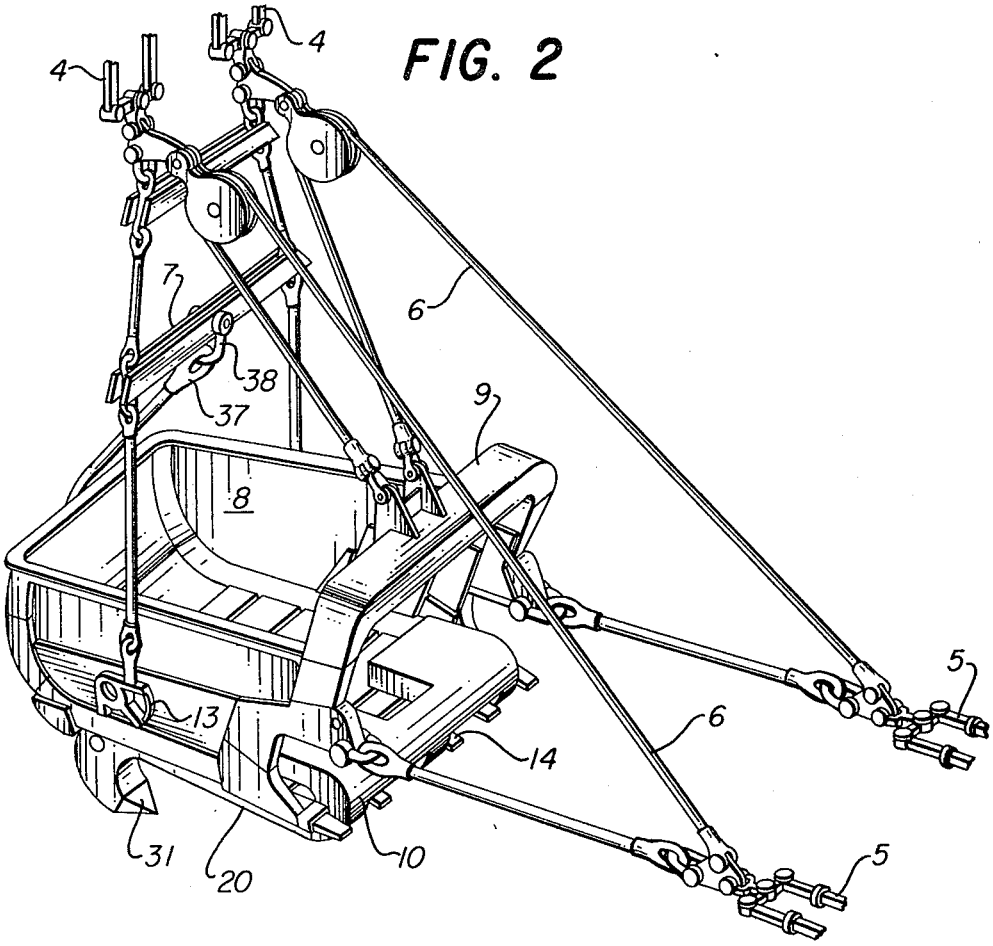
FIG. 2 is an isometric view of a conventional dragline bucket on which is mounted a ripping attachment in accordance with one form of the invention.
Figure 3:
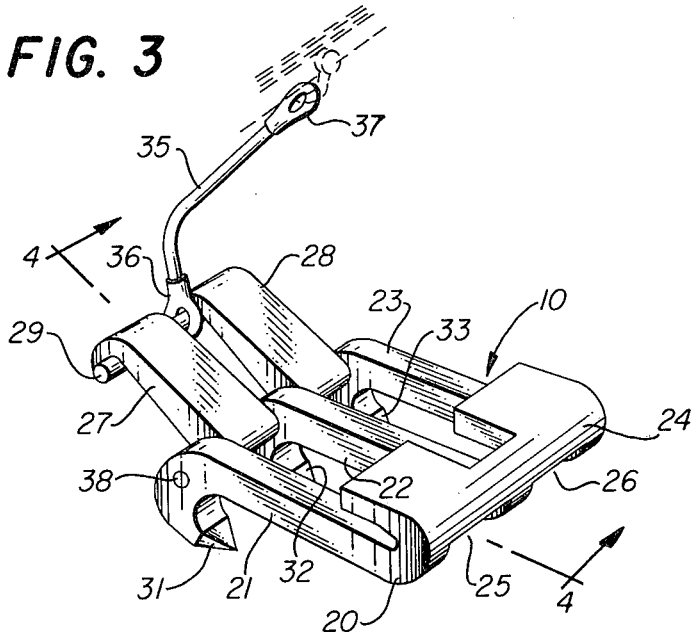
FIG. 3 is a more detailed isometric view of the ripping attachment of FIG. 2.
Figure 4:
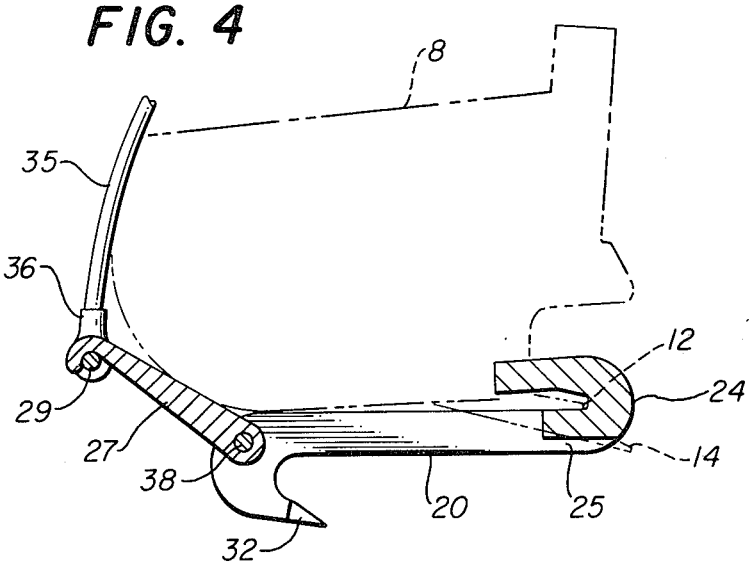
FIG. 4 is a cross-sectional view of the ripping attachment as taken along the lines 4—4 in FIG. 3.

The dragline bucket 8 is shown in more detail in FIG. 2 along with the rigging of the bucket dump ropes 6, the connection of the hoist ropes 4 and drag ropes 5, and the ripper attachment 10. However, referring first to FIGS. 3 and 4, the attachment 10 has a base, indicated generally by the numeral 20 which in the embodiment shown consists of three parallel spaced bars 21, 22, and 23 integrally joined at the forward end. Also at the forward end of the base 20 is an upwardly folded lip 24 which is adapted to receive the leading or digging edge 12 of the bucket 8. The lip 24 is slotted at 25 and 26 such that it can fit over the teeth 14 of the bucket.

At the other end of the base 20, each of the bars 21, 22, and 23 has an integrally connected ripper tooth designated 31, 32, and 33 respectively. Each ripper tooth is formed such that it is spaced below the base and extends generally parallel therewith toward the front of the bucket and in the direction of the drag ropes 5. The points or cutting edges of the ripper teeth may be inclined slightly downward to promote greater penetration into the material to be ripped.

Means to connect the back end of the ripper attachment 10 to the hoist rigging is also provided. In the particular embodiment shown, a pair of connecting arms 27 and 28 are interposed at one end between the bars 31, 32, and 33 and pivotably connected thereto by the rod 38. The other end of each connecting arm 27 or 28 is formed into a hook configuration adapted to engage a second rod 29. A connecting cable 35 pivotably engages rod 29 through an apertured pendent 36, and is itself attached at its other end to part of the bucket rigging. Specifically as shown in FIG. 2, the cable has a second pendent 37 which connects to a shackle 38 attached to the spreader bar 7 for the hoist ropes 4.

When the dragline operator encounters undiggable overburden which prevents him from continuing his normal operation, he can call for the ripper attachment 10. As an example of one manner of connecting it, the attachment is placed on the bank along the operating arc of the dragline. The dragline operator lowers his bucket on top of base 20 and draws it forward with his drag ropes to engage the leading edge 12 of the bucket in the lip 24 of the attachment. With the hoist ropes slack, the connecting cable 35 can be attached to the spreader bar 7, and the rod 29 slipped under the hook ends of the connecting arms 27 and 28. As the slack is taken out of the hoist ropes 4, the connecting cable will pull the ripper attachment base 20 in snug contact with the underside of the bucket 8 and the lip 24 tightly against the leading edge 12 of the bucket.

The operator can now operate the bucket with the attachment in a nearly conventional manner. He places it on the consolidated overburden and reels in his drag ropes. The ripper teeth 31, 32, and 33 dig in and upset the overburden. The downward inclination of the ripper teeth and the dead weight of the bucket resting on the attachment will enhance the penetration of the teeth. At the same time all the drag power of the dragline is available for ripping the overburden.

The invention has been described in reference to one conceivable embodiment and one method by which the operator might engage it. Numerous variations in the structure of the ripper attachment 10, the specific means for connecting it to either the bucket or bucket rigging, and other methods of use will undoubtedly occur to those familiar with such equipment. For example, the number of ripper teeth will vary according to the condition of a particular mine, the preferences of a mine owner or operator, or the manufacturer's design preferences. A single tooth may be specified to maximize the tearing force, or a pattern or teeth chosen for stability or balance. Some may prefer to make the ripper teeth detachable from the base 20 so that worn or broken teeth can be replaced without removing the attachment, or so that the number or pattern of teeth on a particular attachment can be varied.

While other means for connecting the forward end of the attachment 10 to a dragline bucket are conceivable, the upwardly folded lip 24 offers several advantages. It makes it easier for the operator to initially engage the attachment with his bucket, and it provides efficient transmission of the drag forces from the drag rope through the bucket to the attachment.

Similarly, alternative means for securing the opposite or back end of the attachment 10 to the bucket are conceivable. The base 20 could be directly connected to the bucket, such as by cables attached to the same flanges 14 to which the hoist ropes connect. On the other hand, the connecting cable 35 can either be rather permanently attached to the hoist rigging and readily engageably or disengageable to the ripper attachment base as shown, or vice versa. Or it may be desirable to make the connecting cable 35 quickly detachable at both ends. Finally, the base itself could be one solid body or it can be relieved as shown taking into consideration its own weight for handling purposes.

Accordingly the various modifications and alternative embodiments which will occur to those skilled in the art are considered within the scope of the present invention as defined in the appended claims.

The embodiments of the invention in which an exclusive property or privilege is claimed are defined as follows:

1. A detachable earth ripping attachment for use with a conventional dragline bucket said bucket having an underside, a leading edge, a rear wall and drag ropes attached to said bucket, comprising:

a base adapted to fit against and extend along the underside of the bucket, the base having at one end an upwardly folded lip adapted to fit freely over the leading edge of the bucket, and having at its other end disengageable means passing around the rear wall of the bucket and connectable to the hoist ropes for holding the attachment in place against the bucket; and a ripper tooth connected to but spaced below the base within the perimeter of the bucket bottom and having its cutting edge pointing in the same direction as the leading edge of the bucket, such that as the drag ropes pull the bucket across an unbroken earth surface the attachment is drug along by the leading edge of the bucket and the ripper tooth will cut into the surface and the penetration of the tooth will be enhanced by the weight of the dragline bucket.

2. A detachable earth ripping attachment for use with a conventional dragline bucket, comprising:

a base adapted to fit against and which extends substantially the length of the underside of the bucket, the base having at one end an upwardly folded lip adapted to fit over the leading edge of the bucket and said lip being slotted to fit around digging teeth along the leading edge of the bucket, and said base having at its other end means for connecting the attachment to the hoist ropes for the bucket; and a ripper tooth connected to but spaced below the base and having its cutting edge pointing in the same direction as the leading edge of the bucket, such that as the drag ropes pull the bucket across an unbroken earth surface the ripper tooth will cut into the surface and the penetration of the tooth will be enhanced by the weight of the dragline bucket.

3. A detachable earth ripping attachment for use with a conventional dragline bucket, comprising:

a base adapted to fit against and which extends substantially the length of the underside of the bucket, the base having at one end an upwardly folded lip adapted to fit over the leading edge of the bucket, and having at its other end means for connecting the attachment to the hoist ropes for the bucket; and a plurality of ripper teeth spaced across the width of the base, each being connected to but spaced below the base and having its cutting edge pointing in the same direction as the leading edge of the bucket, such that as the drag ropes pull the bucket across an unbroken earth surface the ripper teeth will cut into the surface and the penetration of the teeth will be enhanced by the weight of the dragline bucket.

4. A detachable earth ripping attachment for use with a conventional dragline bucket, comprising:

a base adapted to fit against and which extends substantially the length of the underside of the bucket, the base having at one end an upwardly folded lip adapted to fit over the leading edge of the bucket, and having at its other end means for connecting the attachment to the hoist ropes for the bucket including a connector arm pivotably connected at one end to the base and having at its other end a hook adapted to engage a rod attached to the hoist ropes; and a ripper tooth connected to but spaced below the base and having its cutting edge pointing in the same direction as the leading edge of the bucket, such that as the drag ropes pull the bucket across an unbroken earth surface the ripper tooth will cut into the surface and the penetration of the tooth will be enhanced by the weight of the dragline bucket.

5. An earth ripping attachment as recited in claim 4, wherein said connecting means further includes a flexible cable attached at one end to a spreader bar between the hoist ropes of the dragline, and at its other end to a rod engaging the hooked end of the connecting arm.

* * * * *